US007086953B2

(12) United States Patent
Pinder

(10) Patent No.: US 7,086,953 B2
(45) Date of Patent: Aug. 8, 2006

(54) GOLF PUTTER AND PUTTING AID

(76) Inventor: Bernard L. Pinder, 15121 Deremo Ave., Grand Haven, MI (US) 49417

( * ) Notice: Subject to any disclaimer, the term of this patent is extended or adjusted under 35 U.S.C. 154(b) by 0 days.

(21) Appl. No.: 10/853,613

(22) Filed: May 25, 2004

(65) Prior Publication Data

US 2005/0101403 A1 May 12, 2005

Related U.S. Application Data

(63) Continuation-in-part of application No. 29/193,477, filed on Nov. 10, 2003, now Pat. No. Des. 495,390, and a continuation of application No. 29/193,483, filed on Nov. 10, 2003, now Pat. No. Des. 495,389.

(51) Int. Cl.

| | |
|---|---|
| ***A63B 53/10*** | (2006.01) |
| ***A63B 53/12*** | (2006.01) |
| ***A63B 69/36*** | (2006.01) |
| ***A63B 57/00*** | (2006.01) |

(52) U.S. Cl. ..... 473/174; 473/195; 473/316

(58) Field of Classification Search ..... 473/159, 473/172–174, 195–196, 150, 181, 157–158, 473/160; D21/790–791

See application file for complete search history.

(56) References Cited

U.S. PATENT DOCUMENTS

| | | | | | |
|---|---|---|---|---|---|
| 1,582,237 | A * | 4/1926 | Angell | 473/158 |
| 2,150,737 | A * | 3/1939 | Chittick | 473/315 |
| 2,592,713 | A * | 4/1952 | Koch et al. | 473/182 |
| 3,081,090 | A * | 3/1963 | Congleton | 473/172 |
| 3,356,370 | A * | 12/1967 | Larsen | 473/172 |
| 3,464,697 | A * | 9/1969 | Robillard | 473/410 |
| D241,259 | S * | 8/1976 | Perotta | D21/790 |
| 4,199,144 | A * | 4/1980 | Skelly | 473/251 |
| 4,667,964 | A * | 5/1987 | Hickey | 473/172 |
| D372,289 | S * | 7/1996 | Whittaker | D21/790 |
| 5,545,094 | A * | 8/1996 | Hsu | 473/317 |
| 5,547,189 | A * | 8/1996 | Billings | 473/305 |
| 5,785,604 | A * | 7/1998 | Johnson | 473/265 |
| 5,792,007 | A * | 8/1998 | Billings | 473/305 |
| 5,882,267 | A * | 3/1999 | Roe | 473/265 |
| 5,976,032 | A * | 11/1999 | You | 473/319 |
| 6,890,273 | B1 * | 5/2005 | Perez | 473/404 |
| 2002/0072432 | A1 * | 6/2002 | Hirata | 473/316 |
| 2004/0082402 | A1 * | 4/2004 | Unosawa | 473/316 |

* cited by examiner

*Primary Examiner*—Stephen Blau
(74) *Attorney, Agent, or Firm*—Watson IP Group, PLC; Jovan N. Jovanovic; Vladan M. Vasiljevic

(57) ABSTRACT

A golf putter and putting aid. The golf putter comprises a putter head, a shaft and a grip. The head includes a face, a sole and a handle attachment. The shaft includes a first end, a second, a reinforcing means and an interior region having a fill assembly positioned therein. The grip is coupled to the second end of the shaft. The putting aid comprises a base, opposing leg members and securing means. The base includes an upper surface and a lower surface. The opposing leg members extend upwardly from the upper surface of the base and are separated from each other a distance at least slightly greater than the diameter of a golf ball. The securing means secures at least one of the base and the opposing leg members to a putting surface.

9 Claims, 3 Drawing Sheets

GOLF PUTTER AND PUTTING AID

CROSS-REFERENCE TO RELATED APPLICATION

The present application is a continuation-in-part of U.S. Design patent application Ser. No. 29/193,477 now U.S. Pat. No. D, 495,390 and 29/193,483 now U.S. Pat. No. D, 495,389 each filed on Nov. 10, 2003, the entire disclosure of which is incorporated by reference.

BACKGROUND OF THE INVENTION

1. Field of the Invention

The present invention relates in general to golf equipment, and more particularly to a golf putter and a putting aid used in conjunction with the golf putter, as well as other golf putters.

2. Background Art

Golf putters have long been known in the art. While the object is quite simple, namely, putting a golf ball into a hole positioned on a putting surface, the execution remains difficult. Over time, the golf putter has greatly changed and technology relative to such clubs has greatly increased. While great improvements have been made to putters, problems persist.

For example, it is often difficult to properly repeat a putting stroke, inasmuch as the club sole is easily positionable in a number of different orientations. Moreover, the shafts of golf clubs are often lack the necessary rigidity and damping to provide feedback to the user. Furthermore, putting aids often do not assist a golfer to improve both the reading of putting surfaces and the proper putting of a golf ball along the desired trajectory read by the golfer.

Accordingly, it is an object of the invention to overcome the deficiencies of the prior art. Namely, it is an object of the present invention to provide a golf club which interfaces with the putting surface in such a manner that allows for repeatability relative to club position and inclination.

It is a further object of the invention to provide an improved shaft for use in association with golf putters.

It is another further object of the present invention to provide a putting aid which can assist a user to both improve the reading of putting surfaces as well as the putting of a golf ball along the chosen trajectory.

These and other objects will become apparent in light of the specification and claims appended hereto.

SUMMARY OF THE INVENTION

The invention comprises a golf putter and putting aid. The golf putter comprises a putter head, a shaft and a grip. The head includes a face, a sole and a handle attachment. The shaft includes a first end, a second, a reinforcing means and an interior region having a fill assembly positioned therein. The grip is coupled to the second end of the shaft. The putting aid comprises a base, opposing leg members and securing means. The base includes an upper surface and a lower surface. The opposing leg members extend upwardly from the upper surface of the base and are separated from each other a distance at least slightly greater than the diameter of a golf ball. The securing means secures at least one of the base and the opposing leg members to a putting surface.

In a preferred embodiment, the reinforcing means of the shaft comprises a pair of spaced apart sets of ribs extending circumferentially about the shaft. In one such embodiment, the first set of ribs are positioned substantially approximately 3 to 5 inches from the first end of the shaft. In another embodiment, the second set of ribs are positioned substantially approximately 9 and 15 inches from the first end of the shaft.

In another embodiment, the fill assembly comprises a polymer material which is at least partially bonded to an inner surface of the shaft. In one such embodiment, the fill assembly comprises a polyurethane foam.

In another preferred embodiment, each of the opposing leg members include front faces. The front faces of the opposing leg members are substantially perpendicular to a channel defined therebetween and above the base.

In another preferred embodiment, the releasable securing means comprises at least one opening extending through each of the opposing leg members, and, at least one peg member capable of extending through each of the at least one openings and into a putting surface.

In one preferred embodiment, the releasable securing means comprises a tacky member releasably coupled to one of the lower surface of the base and the opposing leg members.

BRIEF DESCRIPTION OF THE DRAWINGS

The invention will now be described with reference to the drawings wherein.

DETAILED DESCRIPTION OF THE INVENTION

Figure 1:
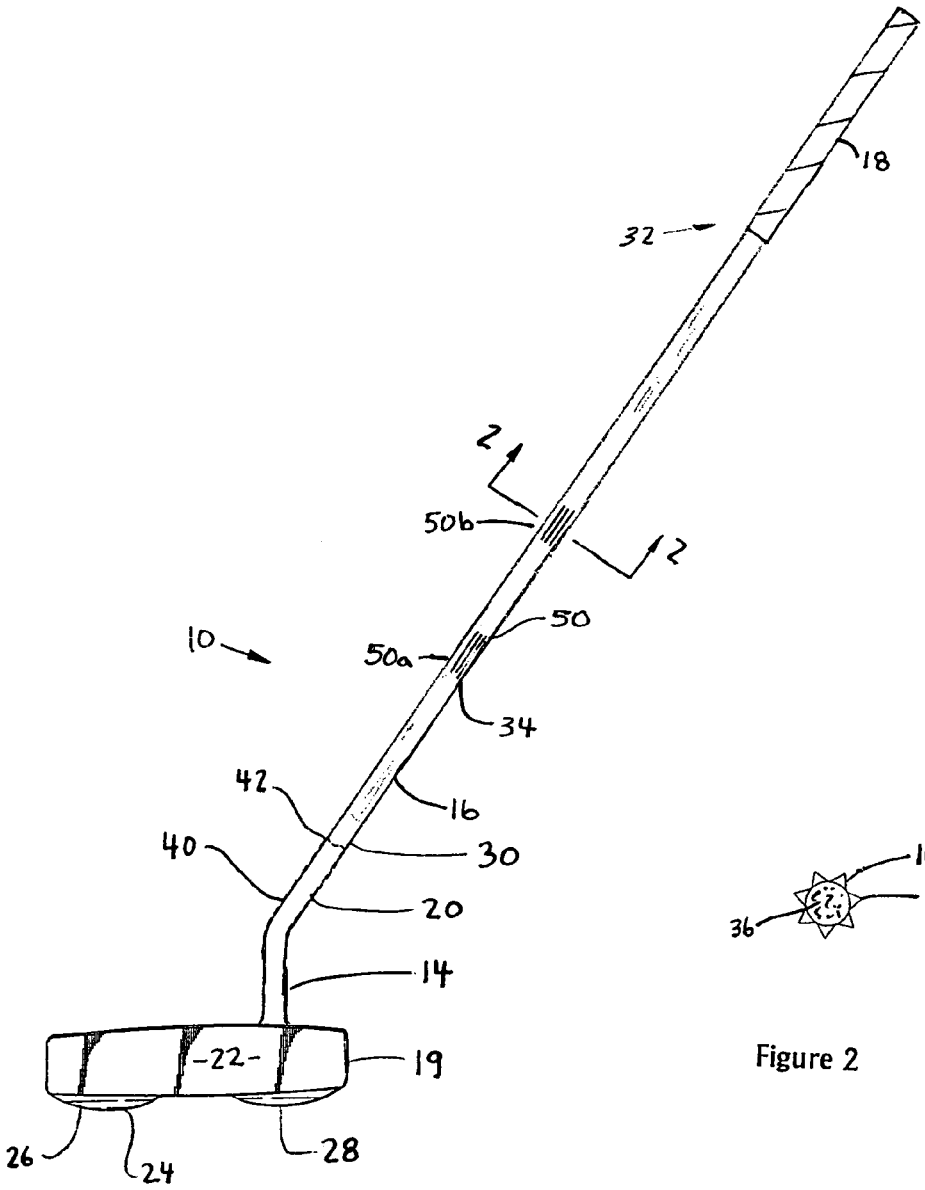
FIG. 1 of the drawings comprises a front plan view of the golf putter of the present invention.

While this invention is susceptible of embodiment in many different forms, there is shown in the drawings several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters. In addition, it will be understood that the drawings are merely representations of the present invention, and some of the components may have been distorted from actual scale for purposes of pictorial clarity.

Figure 4:
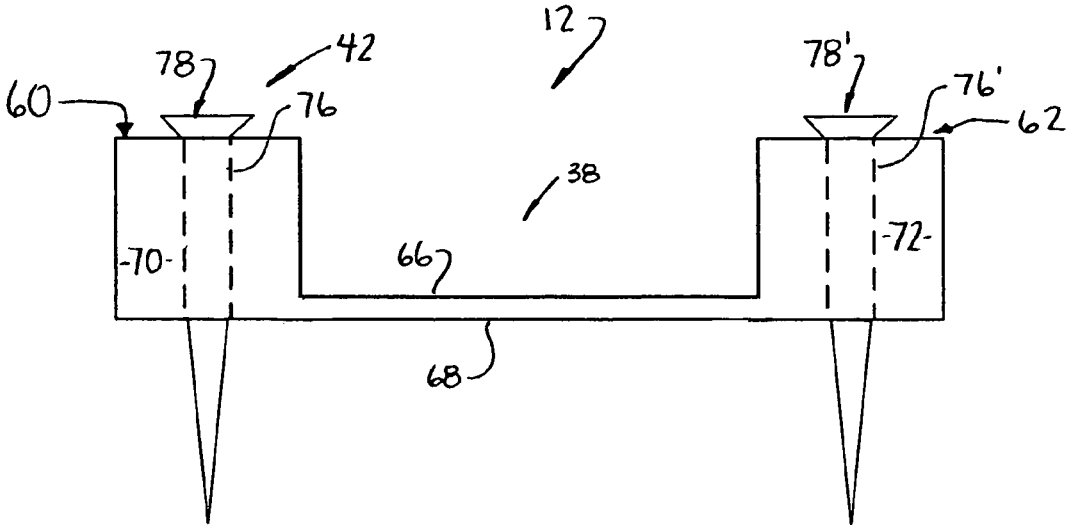
FIG. 4 of the drawings comprises a side elevational view of the putting aid of the present invention.

Referring now to the Figures, and in particular to FIG. 1, the golf putter of the present invention is shown generally at 10. The putter aid of the present invention is shown in FIG. 4, generally at 12. It will be understood that the golf putter and the golf putter aid can be used together, and, are designed indeed for use together. It will be understood that the golf putter aid may be utilized with a different golf putter, and the golf putter of the present invention can be used without the putter aid.

Figure 2:
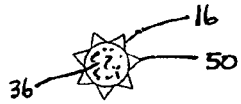
FIG. 2 of the drawings comprises a cross-sectional view of the golf putter of the present invention taken along lines 2—2 of FIG. 1.
Figure 3:
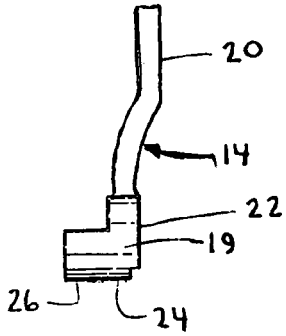
FIG. 3 of the drawings comprises a side elevational view of the golf putter of the present invention.

Golf putter 10 is shown in FIGS. 2 and 3 as comprising putter head 14, shaft 16 and grip 18. Putter head 14 is shown as comprising body 19 having face 22, sole 24 and handle attachment 20. Face 22 is positioned for contact with a golf ball on the putting green. Sole 24 is shown as including first protrusion 26 and second protrusion 28 offset a distance from first protrusion 26. First and second protrusions are both arcuate in configuration such that in operation the first and second protrusions contact the putting surface substantially tangentially. Preferably the tangential contact regions of the first and second protrusions are spaced apart from each other so as to provide stability. With reference to FIG. 3, the first and second protrusion each include a front face which is offset from face 22. Preferably, the front faces of the protrusions are substantially parallel with face 22. Of course, other configurations are likewise contemplated.

Handle attachment 20 is shown as comprising shaft region 40 which extends away from the remainder of body 19. The shaft region 40 includes a second end 42 which is configured to receive shaft 16. In other embodiments, handle attachment 20 may comprise a bore which extends into body 19. The bore in such an embodiment is configured for receipt of shaft 16. Of course, other structures for attachment of shaft 16 to the head are contemplated for use.

Shaft 16 is shown in FIG. 1 as comprising a tube having a first end 30, second end 32, means 34 for reinforcing the shaft, and fill assembly 36 (FIG. 2) positioned therein. First end 30 of shaft 16 is coupled to handle attachment 20. Second end 32 is coupled to grip 18. Indeed, grip 18 may comprise any number of different natural and synthetic grips conventionally available.

Shaft reinforcing means 34 is shown in FIG. 1 as comprising a plurality of circumferentially spaced apart ribs 50 extending longitudinally along the shaft. In a preferred embodiment two sets of ribs 50*a*, 50*b* are positioned on the shaft. Ribs 50*a* shall begin substantially approximately 3 to 5 inches from the first end of the shaft and ribs 50*b* shall begin substantially approximately 9 to 15 inches from the first end of the shaft. Each of the ribs may be between substantially approximately 2 to 5 inches. In certain embodiments, the first and second set of ribs can be integrated into a single set of ribs having an extended length. The positioning of the ribs, in the orientations identified above, limits the flexing of the shaft for purposes of putting.

Fill assembly 36, as is shown in FIG. 2, comprises a material positioned within inner region 37 of shaft 16. The fill assembly may comprise a closed cell polymer, such as a polyurethane, and the like. Such a material can be sprayed into the inner region of the shaft and allowed to cure therein. Fill assembly 36 maintains a bond relative to the surface of inner region 37. Of course, while such materials are greatly preferred, other materials may comprise solid materials, such as polymer materials which may be granulated and positioned within inner region 37 of the shaft. Preferably such materials are densely packed and may be mixed with a bonding agent to promote the adhesion of the granulated material to itself and to the surface of inner region 37.

Figure 5:
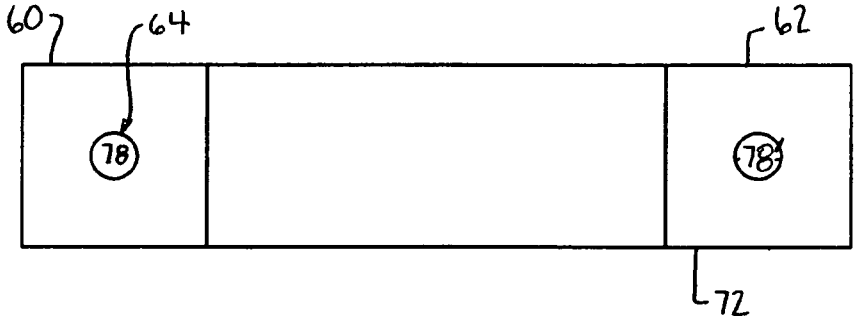
FIG. 5 of the drawings comprises a top plan view of the putting aid of the present invention.

Putting aid 12 is shown in FIGS. 2, 4 and 5 as comprising base 38, opposing leg members 60, 62 on either end of base 38, and means 64 for releasably securing the putting aid to an outside surface, such as a putting surface. Base 38 includes upper surface 66 and lower surface 68. The thickness of base 38 is minimized such that the upper surface and lower surface are minimally separated. Upper surface 68 may be substantially planar or may be slightly domed. For example, upper surface 68 may include a beveled edge (at, for example, 20° to 30°, among others) at the opposing edges thereof, to facilitate the passage of a golf ball thereover. The base separates opposing leg members 60, 62 by a distance substantially corresponding to the diameter of a golf ball. For example, the width of the upper surface may comprise approximately 2 to 2.5 inches (with the diameter being substantially about 1.68 inches). The depth of the upper surface may be approximately 0.85 to 1.1 inches, while other dimensions are likewise contemplated. It is contemplated that a number of different putting aids may be included in a kit, wherein successive putting aids include successively and incrementally narrower or wider bases.

Each opposing leg member extends outwardly from upper surface 66. It is desirable that the opposing leg members have a height substantially approximately 0.5 to 1 inch, while other dimensions are likewise contemplated. Preferably, the front faces of the opposing leg members 70, 72 are substantially perpendicular to the desired direction of travel of a golf ball. The width of each of the leg members may be approximately 0.5 inches to approximately 0.75 inches.

Releasable securing means 42 is shown in FIG. 4 as comprising openings 76, 76' extending through opposing leg members 60, 62, and peg members 78, 78'. It will be understood that the peg members are driven through the respective openings and into the putting surface to releasably secure the putting aid to the putting surface. In certain embodiments, the peg members may comprise golf tees.

In other embodiments, the releasable securing means may comprise a tacky surface which is suitable for releasable adhesion to, for example, synthetic putting surfaces. In yet other embodiments, the releasable securing means may comprise protrusions releasably or permanently attached to the under surface of either of the leg members and the base, wherein the protrusions can be driven into the putting surface.

Figure 6:
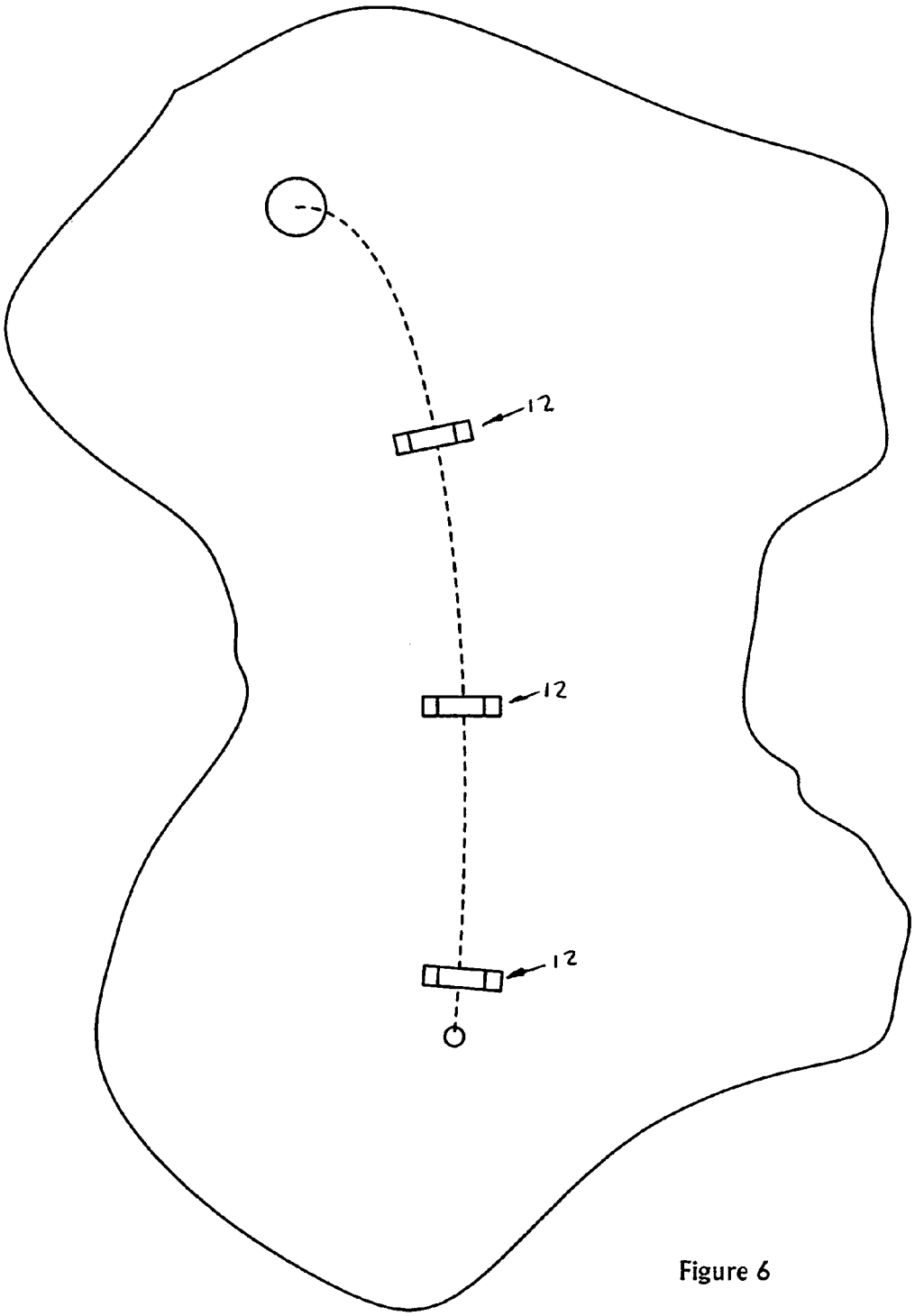
FIG. 6 of the drawings comprises a top plan view of multiple putting aids of the present invention in use.

In operation of the putting aid, the user can place one or more putting aids along a desired travel of a golf ball (or along the path that the golfer believes the golf ball will travel). For example, as is shown in FIG. 6, three putting aids are positioned along the predicted trajectory of the golf ball. For example, the first putting aid can be positioned approximately 6 inches to 18 inches from the initial position of the ball. Subsequent putting aids can be space apart at intervals of, for example, a foot. A greater or lesser number of putting aids may be utilized as desired. Next, the golfer addresses the ball and proceeds with the swing. If the trajectory was well read by the golfer, and the golf ball was properly hit, the golf ball should proceed between the leg members of each of the putting aids and over the upper surface of the base.

However, in the event that the golf ball does not proceed through the putting aids, the golfer can then address whether the trajectory was poorly read by the golfer, or whether the ball was not properly hit. Successive practice with the putting aids will improve both the reading of greens and the improved hitting along a desired trajectory. Advantageously, the base of the putting aid is thin such that it does not impede the travel of the golf ball, yet, provides a proper distance between the leg members. Additionally, by connecting the leg members with a base instead of forming a tunnel, the trajectory of the ball is not visually impeded, and the golfer has a view of the golf ball along the entirety of the trajectory of the ball.

The foregoing description merely explains and illustrates the invention and the invention is not limited thereto except insofar as the appended claims are so limited, as those skilled in the art who have the disclosure before them will be able to make modifications without departing the scope of the invention.

What is claimed is:

1. A golf putter and putting aid comprising:

a golf putter comprising:

a putter head having a face, a sole and a handle attachment a shaft having a first end, a second, a reinforcing means, the reinforcing means comprising a set of ribs positioned substantially uniformly about the entire circumference of at least a portion of the shaft, the set of ribs increasing the rigidity of the shaft substantially uniformly about the entire circumference thereof; and a grip coupled to the second end of the shaft; and a putting aid comprising:

a base having an upper surface and a lower surface;

opposing leg members extending upwardly from the upper surface of the base, the opposing leg members separated from each other a distance at least slightly greater than the diameter of a golf ball; and means for securing at least one of the base and the opposing leg members to a putting surface, wherein the releasable securing means comprises:

at least one opening extending through each of the opposing leg members; and at least one peg member capable of extending through each of the at least one openings and into a putting surface.

2. The golf putter of claim 1 wherein the reinforcing means further comprises a second set of spaced apart sets of ribs positioned substantially uniformly about the entire circumference of at least a portion of the shaft, the second set of ribs increasing the rigidity of the shaft substantially uniformly about the entire circumference thereof.

3. The golf putter and puffing aid of claim 2 wherein the first set of ribs are positioned substantially approximately 3 to 5 inches from the first end of the shaft.

4. The golf putter and putting aid of claim 3 wherein the second set of ribs are positioned substantially approximately 9 to 15 inches from the first end of the shaft.

5. The golf putter and putting aid of claim 1 further comprising an interior region, the interior region including a fill assembly positioned therein, wherein the fill assembly comprises a polymer material which is at least partially bonded to an inner surface of the shaft.

6. The golf putter and putting aid of claim 5 wherein the fill assembly comprises a polyurethane foam.

7. The golf putter and putting aid of claim 1 wherein each of the opposing leg members include front faces, the front faces of the opposing leg members are substantially perpendicular to a channel defined therebetween and above the base.

8. A putting aid comprising:

a base having an upper surface and a lower surface;

opposing leg members extending upwardly from the upper surface of the base, the opposing leg members separated from each other a distance at least slightly greater than the diameter of a golf ball; and means for securing at least one of the base and the opposing leg members to a putting surface, the securing means comprising, at least one opening extending through each of the opposing leg members; and at least one peg member capable of extending through each of the at least one openings and into a putting surface.

9. The putting aid of claim 8 wherein each of the opposing leg members include front faces, the front faces of the opposing leg members are substantially perpendicular to a channel defined therebetween and above the base.

* * * * *